US005295441A

United States Patent [19]

Kawanishi et al.

[11] Patent Number: 5,295,441

[45] Date of Patent: Mar. 22, 1994

[54] SLIDING DOOR APPARATUS FOR PLATFORM

[75] Inventors: Isamu Kawanishi; Yukio Uozumi, both of Kobe, Japan

[73] Assignee: Kawasaki Jukogyo Kabushiki Kaisha, Japan

[21] Appl. No.: 917,954

[22] Filed: Jul. 24, 1992

[30] Foreign Application Priority Data

Jul. 31, 1991 [JP] Japan ..... 3-60405[U]
Jul. 31, 1991 [JP] Japan ..... 3-191750
Jul. 31, 1991 [JP] Japan ..... 3-191751

[51] Int. Cl.[5] ..... B61B 1/02

[52] U.S. Cl. ..... 104/28; 105/339; 105/341

[58] Field of Search ..... 104/27, 28, 30; 105/339, 332, 341, 343; 49/128, 130, 118, 209, 210; 160/186, 187, 188, 199, 206

[56] References Cited

U.S. PATENT DOCUMENTS 4,048,755 9/1977 Wolak et al. ..... 49/130

FOREIGN PATENT DOCUMENTS 3132296 3/1983 Fed. Rep. of Germany ..... 104/28
3214602 10/1983 Fed. Rep. of Germany ..... 104/28
0018516 2/1979 Japan ..... 105/343
0027114 3/1979 Japan ..... 105/343
57-2537 1/1982 Japan .
0102866 4/1990 Japan ..... 105/339
0109165 5/1991 Japan ..... 105/341
0466466 5/1937 United Kingdom ..... 49/130
2204082 2/1988 United Kingdom .

*Primary Examiner*—Mark T. Le
*Attorney, Agent, or Firm*—Oliff & Berridge

[57] ABSTRACT

A sliding door apparatus for a railway platform, has a plurality of sliding doors provided along an edge of a railway platform, the plurality of sliding doors being, in a closed position, arranged continuously along a line; a sliding door shifting apparatus for shifting those of the sliding doors to be opened and closed into shifted positions parallel to the closed position of the plurality of sliding doors; opening/closing apparatus for opening and closing the sliding doors disposed at the shifted positions, the opening/closing apparatus being capable of moving the sliding doors in varying directions and amounts; and a logic apparatus for analyzing information regarding the positions and widths of entrances of a railway vehicle stopped at the platform, selecting the sliding doors to be shifted, and controlling the shifting and opening/closing of the sliding doors such that the sliding doors are opened and closed in conformity with the entrances of the railway vehicle.

1 Claim, 18 Drawing Sheets 18
18
18

SLIDING DOOR APPARATUS FOR PLATFORM

BACKGROUND OF THE INVENTION

1. Field of the Invention

This invention relates to a driving apparatus for opening and closing doors, and particularly to a sliding door apparatus for a railway platform. The opening of the sliding doors can be made to coincide with the entrances of any type of railway vehicle stopping at the platform.

2. Description of the Prior Art

It is proposed by the official gazette of Japanese Patent Publication Application No. 57-2537 to form, at a platform for railway vehicles, a partition including a wall on the side of the platform facing the track and sliding doors on a face of the wall. The opening position of the sliding doors is adjusted in response to an error in the stopping position of a railway vehicle, to assure the safety of passengers or enhance the air conditioning efficiency of a building formed at the platform. This type of structure functions well when the type of railway vehicle is fixed.

However, with this conventional sliding door apparatus, when railway vehicles of many different types stop at the platform, the sliding doors cannot be opened in conformity with vehicle entrances which vary widely in position and dimension. Particularly where it is necessary to change the sliding directions of the sliding doors, this conventional apparatus does not function satisfactorily.

SUMMARY OF THE INVENTION

It is an object of the present invention to provide a sliding door apparatus for a railway platform and the like wherein the position and width at which the doors are opened can be adjusted and the directions in which the doors are opened and closed are variable.

According to one aspect of the present invention, a door opening and closing driving apparatus for a platform is provided. A driven roller is provided on each of a plurality of sliding doors. Driving rollers for engaging the driven rollers are provided, and the driving rollers are set at a distance smaller than the length of the driven rollers. The driving rollers of the doors perform the necessary opening operations to open the sliding doors in conformity with the entrances of a railway vehicle.

According to another aspect of the present invention, a door opening and closing driving apparatus for a platform is provided wherein each of a plurality of sliding doors has an opening end. Opening and closing acting bodies are each provided with an engaging element engageable with the door end. Each of the opening and closing acting bodies is provided with a driven roller, and driving rollers for engaging with the driven rollers are provided. The driving rollers are set to a distance smaller than the length of the driven rollers. The driving rollers of the doors perform opening operations necessary to correspond with the positions and dimensions of the entrances of a railway vehicle.

In the construction mentioned above, the driving rollers which rotate with intersecting angles in order to move the driven rollers in predetermined directions are contacted with the driven rollers provided directly on the sliding doors. Alternately, in the case of folding doors, the driven rollers are held in engagement with the folding doors. Consequently, each of the driven rollers and sliding doors are moved a distance equal to the rolling distance of the driving roller multiplied by the sine of the intersecting angle.

The opening and closing driving sections provided with the driving rollers are disposed at a distance shorter than the length of the driven rollers. The sliding doors or the folding doors can be opened and closed to and from an opening of any variable size directly by way of the driven rollers or by way of the opening and closing acting bodies without being limited by the width of the doors. By adjusting the intersecting angle of the driving rollers, the strokes of the doors can be adjusted. The opening and closing directions of the doors can be reversed by changing the intersecting angle from a positive value to a negative value.

According to still another aspect of the present invention, a sliding door apparatus for a platform is provided wherein a plurality of sliding doors are provided along a platform edge on the platform, at which a railway vehicle stops, such that the sliding doors can be opened and closed in conformity with an entrance of the railway vehicle. The plurality of sliding doors are, in a closed condition, at their stationary fixed positions in which they are arranged continuously in a serial line. A sliding door shifting apparatus is provided for shifting those of the sliding doors which are to be opened and closed in conformity with the entrance of the railway vehicle between the stationary fixed positions and shifted positions at which the sliding doors extend on a linear row parallel to those at the stationary fixed positions. Opening/closing driving apparatus are provided having variable shifting directions and variable shifting stroke amounts of the sliding doors for opening and closing the sliding doors disposed at the shifted positions in conformity with the entrances of the railway vehicle. A logic apparatus is provided for selecting the sliding doors to be shifted from information regarding the position and the width of the entrances of the railway vehicle stopped at the platform, and for setting and controlling the shifting direction and the shifting stroke amount of the sliding doors.

In the construction mentioned above, the plurality of sliding doors are disposed along a serial line in an ordinary closed condition. In order to form an opening corresponding to an entrance of a railway vehicle stopped at the platform, the sliding doors to be opened are shifted from the positions along the serial line to the shifted positions. The sliding doors disposed at the shifted positions can be opened in response to moving directions in stroke amounts for the individual sliding doors so as to conform with the entrance as the logic unit to which various information of the entrance of the railway vehicle is provided executes calculating processing and controls a varying mechanism of the opening and closing driving apparatus. When the sliding doors are to be closed, the sliding doors are closed by reverse operations to those in the opening operation, and then returned from the shifted positions to the stationary fixed positions, and consequently, the sliding doors can be prepared for subsequent opening operation.

According to a further aspect of the present invention, a sliding door apparatus for a railway platform is provided, characterized in that a first sliding door supporting rail and a second sliding door supporting rail are disposed in parallel to each other along a platform edge of a railway platform. A plurality of sliding doors are provided such that they are disposed continuously and alternately on the two sliding door supporting rails while having a small overlap between adjacent sliding doors thereby making closed fixed positions. The sliding door apparatus comprises a logic unit constructed such that the directions of movement and amounts of movement of the plurality of sliding doors disposed alternately and continuously at the closed fixed positions conform with the positions of the entrances of the vehicle and are set and controlled in response to various information relating to the entrance of the vehicle. Door opening and closing driving apparatus are provided for driving the sliding doors variably only in necessary directions and by necessary stroke amounts under the control of the logic unit.

In the construction mentioned above, since the plurality of sliding doors are disposed alternately and continuously on the first sliding door supporting rail and the second sliding door supporting rail and opening and closing driving sections which can operate the individual sliding doors are provided, the sliding doors conforming with an entrance of a vehicle stopped at the platform can be opened in conformity with the entrance. In this instance, movement of the sliding doors is such that they are opened by the door opening and closing driving apparatus, which control the opening and closing driving sections, in response to signals calculated and processed from information regarding a position and a width dimension of the entrance of the vehicle stopped at the platform. Closing of the doors is performed by reverse operation of the door opening and closing driving apparatus.

DETAILED DESCRIPTION OF PREFERRED EMBODIMENTS

In the following, embodiments of the present invention are described with reference to the drawings.

Figure 1:
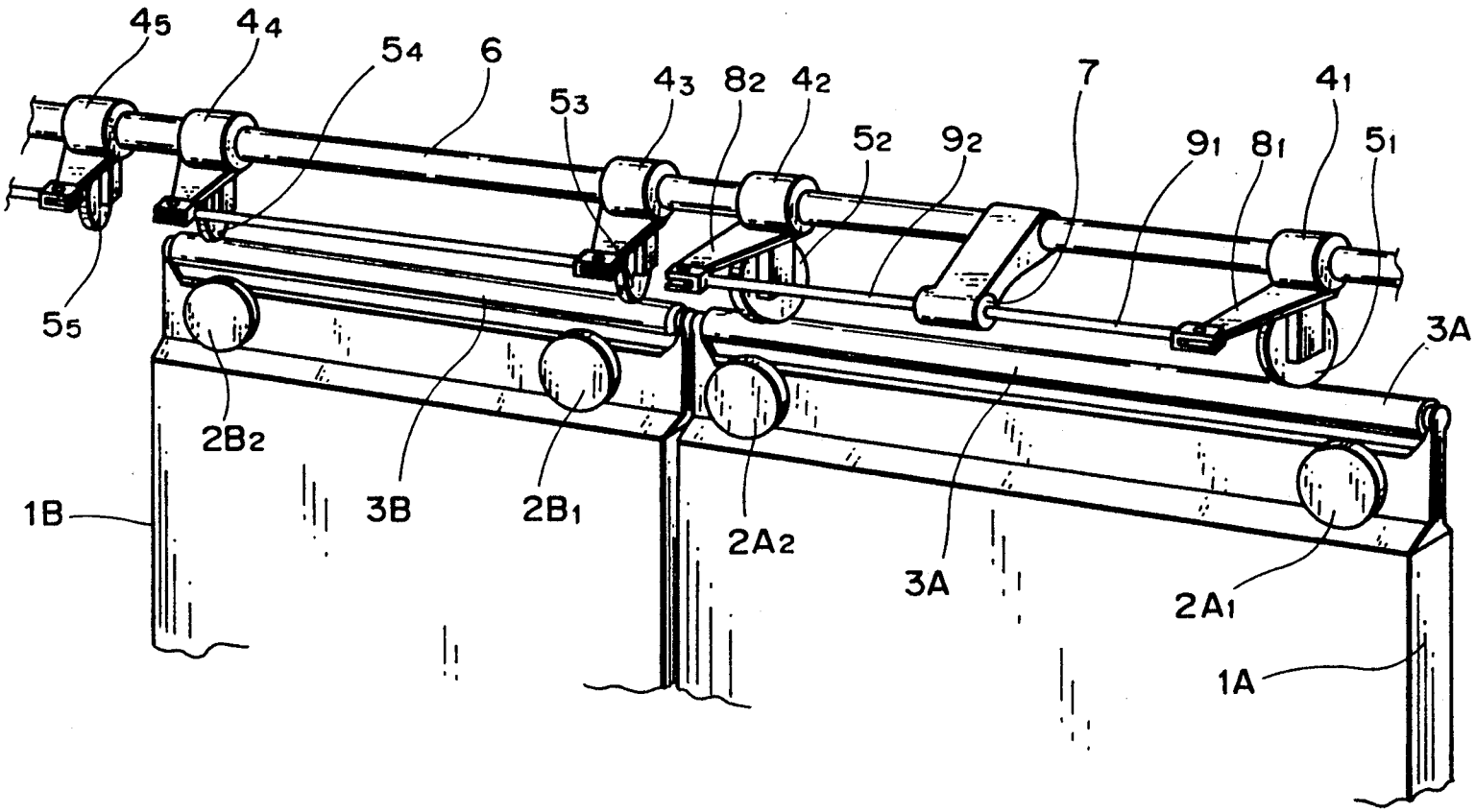
FIG. 1 shows in perspective view an embodiment of an opening and closing driving apparatus of the present invention.

FIG. 1 shows a first embodiment of a door opening and closing driving apparatus of the present invention. In the first embodiment, a sliding door is employed as a door. Sliding doors 1A and 1B are, in the condition shown, in a closed condition. From this condition, the sliding doors 1A and 1B can be opened in conformity with entrances of a railway vehicle by operation of the door opening and closing driving apparatus. Door rollers $2A_1$, $2A_2$, $2B_1$, and $2B_2$ are mounted on brackets formed at upper positions of the sliding doors 1A and 1B. Since the door rollers are placed on a sliding door supporting rail (not shown), the sliding doors 1A and 1B are moved when leftward or rightward force is applied to the sliding doors 1A and 1B.

Driven rollers 3A and 3B are mounted at upper end sides of the brackets provided on the sliding doors 1A and 1B. The individual driven rollers 3A and 3B are held in engagement with driving rollers $5_1$, $5_2$, $5_3$, $5_4$ and $5_5$ provided on door opening and closing driving sections $4_1$, $4_2$, $4_3$, $4_4$ and $4_5$, respectively. Each of the door opening and closing driving sections $4_1$ to $4_5$ is supported on a support shaft 6, and the support shaft 6 supports an actuator 7 thereon. The individual actuators are provided to set intersecting angles of the driving rollers $5_1$ and $5_2$ of the door opening and closing driving sections $4_1$ to $4_2$ with respect to the driven roller 3A of the sliding door 1A and to set intersecting angles of the driving rollers $5_3$ to $5_5$ of the door opening and closing driving sections $4_3$ to $4_5$ with respect to the driven roller 3B of the sliding door 1B. The action of each of the actuators 7 can modify the intersecting angle of the driving roller by way of rods $9_1$ and $9_2$ connected between arm portions $8_1$ and $8_2$ formed on the door opening and closing driving sections $4_1$ and $4_2$, respectively. It is to be noted that the actuators for the left side door opening and closing driving sections $4_3$ to $4_5$, that is, the actuators for the sliding door 1B, are not shown.

When the driving rollers $5_1$ to $5_4$ of the door opening and closing driving sections $4_1$ to $4_4$ rotate, the driving rollers $5_1$ and $5_2$ to which a predetermined intersecting angle is provided by the actuator 7 move the driven roller 3A in the rightward direction, and the sliding door 1A is moved in the rightward direction together with the driven roller 3A. Since the intersecting angle of the driving rollers $5_3$ and $5_4$ is set opposite to the intersecting angle of the driving rollers $5_1$ and $5_2$, the sliding roller 1B is moved in the leftward direction, and the sliding doors 1A and 1B are moved to the opposite sides and opened. The door opening and closing driving section $4_5$ is controlled to the same intersecting angle as the door opening and closing driving section $4_4$ and is engaged with the sliding door 1B fed in the leftward direction so that it provides a greater leftward stroke amount to the sliding door 1B.

The door opening and closing driving sections are disposed continuously such that the pitch between the two door opening and closing driving sections $4_1$ and $4_2$ or $4_3$ and $4_4$ is set smaller than the length of each driven roller. Consequently, feeding of a continuous long stroke can be permitted. In the case wherein the power of the door opening and closing driving sections is concentrated, the support shaft 6 described above can be constructed as a driving shaft, and power can be transmitted to the driving roller by way of gears or the like.

Figure 2:
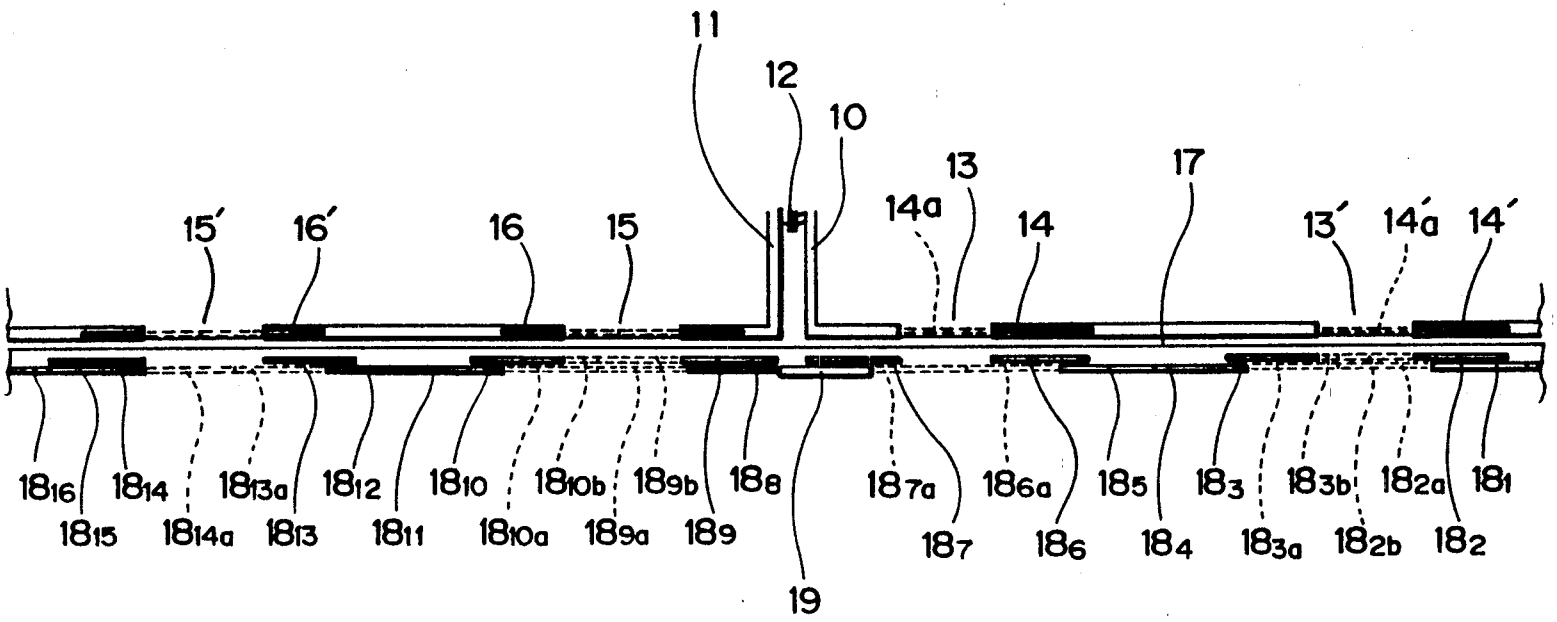
FIG. 2 shows a plan view of a sliding door apparatus for a platform when the opening and closing driving apparatus of FIG. 1 is applied to a railway platform.
Figure 3:
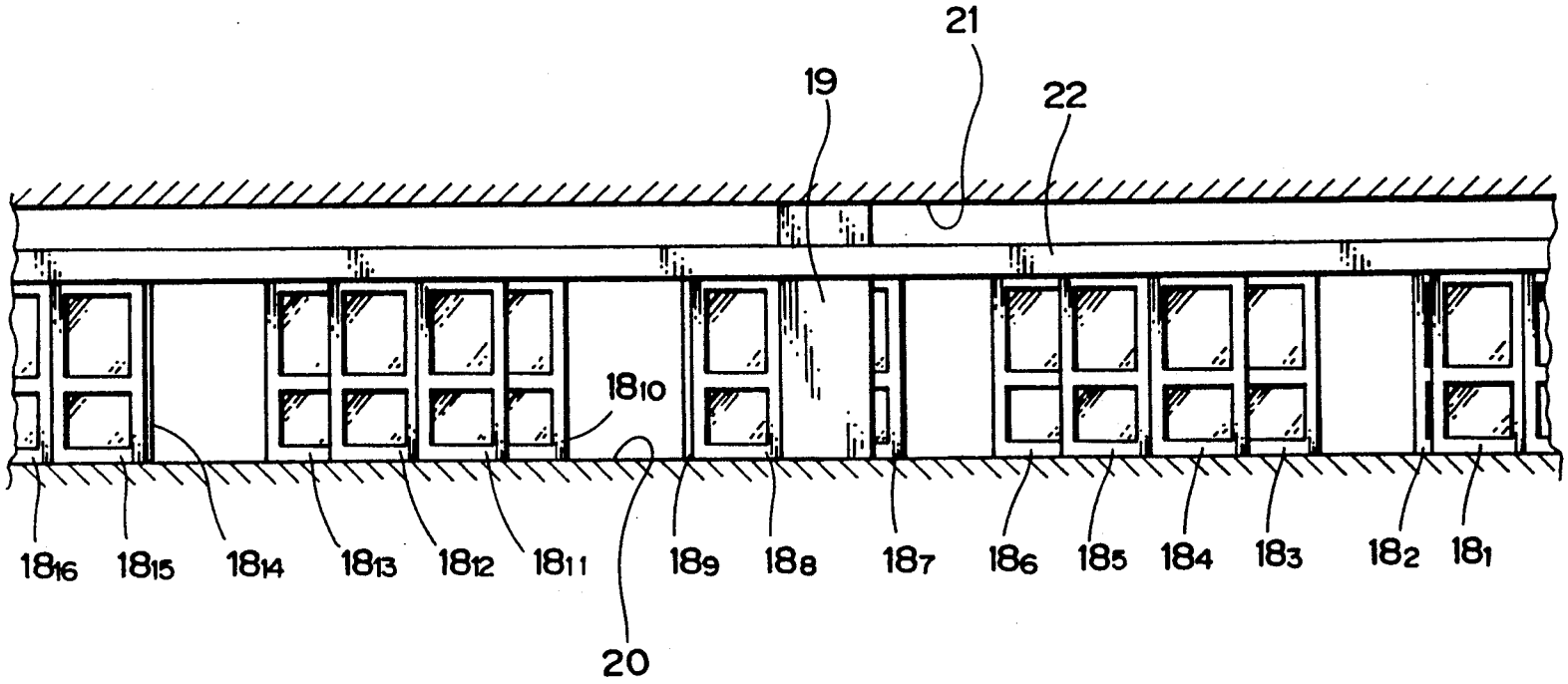
FIG. 3 is a side elevational view of the sliding door apparatus shown in FIG. 2.

A relationship between the entrances of vehicles and sliding doors when the apparatus of the present invention shown in FIG. 1 is applied to sliding doors at a railway platform is illustrated in FIGS. 2 and 3.

FIG. 2 illustrates in plan view a relationship between a railway vehicle and a sliding door apparatus provided with the door opening and closing driving apparatus of the present invention. FIG. 3 is a side elevational view of sliding doors which are a sliding door apparatus. Referring to FIG. 2, reference numerals 10 and 11 each denote a vehicle. Vehicles 10 and 11 are coupled to each other by means of a coupler 12 to constitute a train. A pair of entrances 13 and 13' are formed on the vehicle 10. A pair of sliding doors 14 and 14' of the single sliding type are disposed at the entrances 13 and 13' such that they may open and close the entrances 13 and 13'. At solid line positions shown in FIG. 2, the sliding doors 14 and 14' are in a condition in which they open the entrances 13 and 13'. The sliding doors 14*a* and 14*a*' indicated by broken lines show a condition wherein they close the entrances 13 and 13'. Entrances 15 and 15' of the vehicle 11 are of a different width than those of the vehicle 10 and accordingly are provided with sliding doors 16 and 16' of the double sliding type.

Reference numeral 17 denotes a platform edge of a platform. Sliding doors $18_1$ to $18_7$ and $18_8$ to $18_{16}$ are disposed continuously in a serial row along the platform edge 17. In the drawings, the sliding doors in a closed condition are provided with the suffix a, such as $18_{2a}$, $18_{3a}$, $18_{6a}$, etc., and are indicated by broken lines. Sliding doors in a closed condition are arranged in a straight line and the position of each of the sliding doors is referred to as the stationary fixed position. When the sliding doors are to be opened, the sliding doors are shifted from the broken line positions to alternate long and short dash line positions provided with the suffix b (positions moved in parallel toward the platform edge 17 side, shown only as $18_{2b}$, $18_{3b}$, $18_{6b}$, $18_{9b}$ and $18_{10b}$, hereinafter referred to as shifted positions). They are then shifted to solid line positions (without a suffix) in predetermined directions by predetermined stoke amounts so that openings registered with the entrances 13, 13', 15 and 15' of the vehicles may be formed.

A fixed wall 19 is disposed in a common plane with the sliding doors between the sliding doors $18_7$ and $18_8$. The fixed wall 19 is a location which corresponds to a connecting portion of a train and has no relation with an entrance when any of the various trains are stopped. The positional relationship between the platform and the train in FIG. 2 is such that the center of the fixed wall 19 and the center of the connecting portion of the vehicles do not coincide with each other. A condition is shown wherein the train is stopped at a position displaced leftwardly from the platform. Even in case the stopping position of the train is displaced from a regular stopping position of the platform in this manner, openings of the doors at the positions coinciding with the entrances of the vehicles are formed by the opening and closing driving apparatus for the sliding doors.

While, in the embodiment of the present invention described so far, openings of the doors equal to the size of the entrances described above are formed by movement of the sliding doors at the positions of the entrances of the vehicles, it is also possible to open the doors by amounts greater than the magnitudes of the entrances by controlling the movement of the sliding doors.

FIG. 3 is a side elevational view of the view shown in FIG. 2 and shows a condition wherein the sliding doors are open. Reference numeral 20 denotes a floor of the platform, 21 a ceiling and 22 a door header. Supporting apparatus for the sliding doors and opening and closing driving apparatus are accommodated in the inside of the door header 22.

Figure 4:
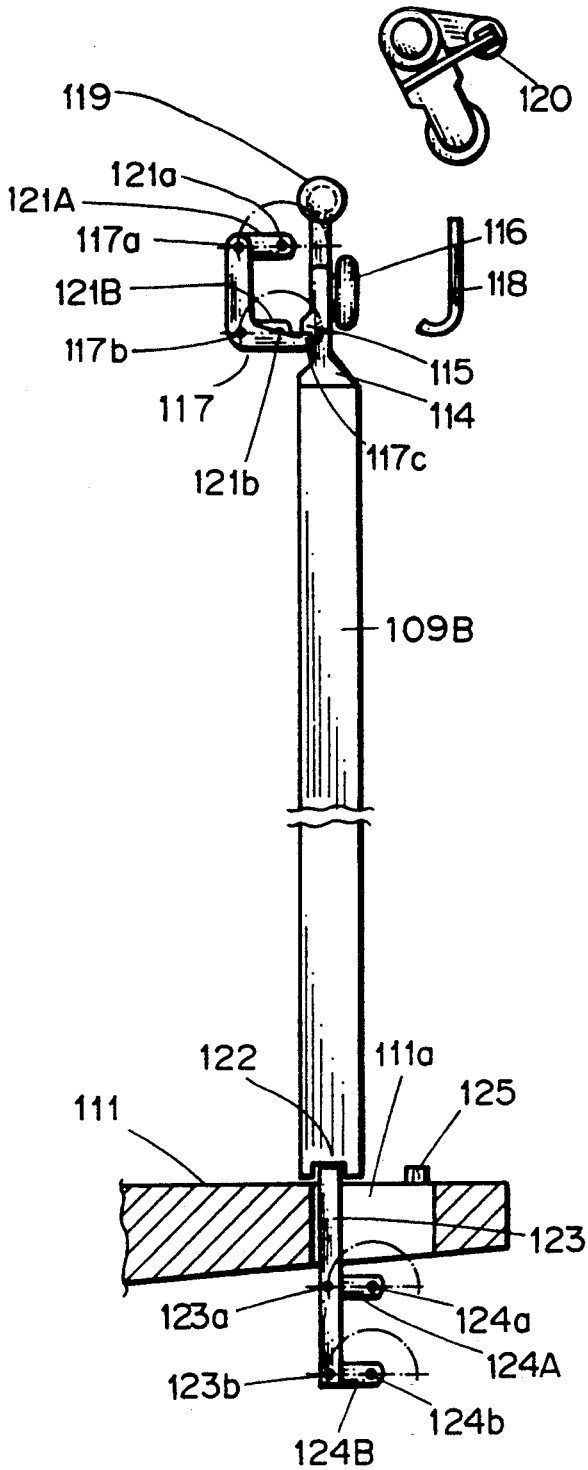
FIG. 4 shows in vertical sectional view an embodiment of part of a sliding door shifting apparatus and an opening and closing driving apparatus of the present invention in a condition wherein the sliding doors are at stationary fixed positions.
Figure 5:
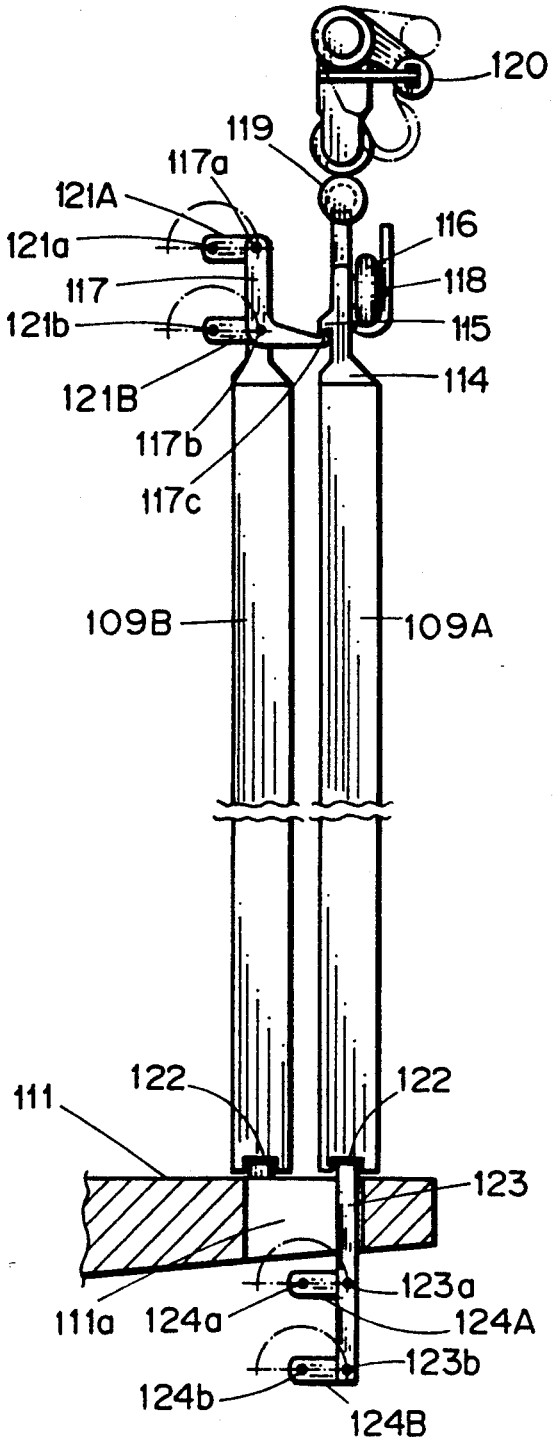
FIG. 5 is a vertical sectional view in a condition wherein a sliding door is disposed to a shifted position in FIG. 4.

FIGS. 4 and 5 show in vertical elevation an embodiment of a shifting apparatus and an opening and closing driving apparatus for a sliding door of the present invention. FIG. 4 shows a condition when the sliding door 109 to be driven to the shifted position is at a stationary fixed position (position at which the suffix a is applied in FIG. 2). FIG. 5 shows a condition wherein the sliding door 109 is disposed at a shifted position. It is to be noted that, in the drawings, when the sliding door is at its stationary fixed position, it is represented by 109B, but when it is at its shifted position, it is represented by 109A. It is to be noted that 109B in FIGS. 4 and 5 indicates a sliding door existing farther than the sliding door 109A.

The shifting apparatus is a mechanism for shifting a sliding door between its stationary fixed position and its shifted position. The shifting apparatus of FIGS. 4 and 5 is provided above and below the sliding door. The shifting apparatus includes, at the upper location, a bracket formed on the sliding door, a hook and a door roller formed on the bracket, a sliding door hanger for engaging with the hook to move the sliding door between the stationary fixed position and the shifted position and a sliding door supporting rail for engaging with the door roller at the shifted position. The shifting apparatus has, at the lower location, a sliding door supporting rod associated with a bottom portion of the sliding door.

In particular, in accordance with the drawings, a bracket 114 is provided at an upper portion of the sliding door 109B. A hook 115 is mounted on one face of the bracket 114 while a door roller 116 is mounted on the other face of the bracket 114. A driven roller 119 (the driven roller constitutes part of an opening and closing driving apparatus which will hereinafter be described) is mounted at an upper end of the bracket 114. Hook 115 is held in engagement with a sliding door hanger 117 which holds the sliding door 109B at the stationary fixed position and can shift the sliding door 109B from the stationary fixed position to the shifted position or from the shifted position to the stationary fixed position. The sliding door 109A shifted from the stationary fixed position to the shifted position by the sliding door hanger 117 is allowed to be opened or closed at the shifted position as the door roller 116 is engaged with the sliding door supporting rail 118.

When the sliding door 109A is shifted to the shifted position, the driven roller 119 can be engaged with a driving roller (not shown) of an opening and closing driving section 120 The driven roller 119 and the opening and closing driving section 120 constitute part of the opening and closing driving apparatus. At the position of FIG. 4, the hook 115 formed on the bracket 114 is supported on the sliding door hanger 117, and the door roller 116 is held spaced away from the sliding door supporting rail 118 while the sliding door 109B is at the stationary fixed position.

The sliding door hanger 117 is constructed such that a pair of cranks 121A and 121B having pivotal center shafts **121*a* and 121*b* are connected at pivoting ends thereof to shaft portions 117*a* and 117*b* at upper and lower ends of an L-shaped vertical arm. An engaging portion 117*c* for engaging with the hook is formed at an end portion of the horizontal arm. Due to the construction, when the cranks 121A and 121B are pivoted by 180 degrees around the shafts 121*a* and 121*b*, the sliding door 109B at the stationary fixed position shown in FIG. 4 is moved, while the hook 115 is held in engagement with the engaging portion 117*c* of the end portion of the horizontal arm, from the position of FIG. 4 to the shifted position of FIG. 5 drawing an arc having a radius equal to the length of the cranks 121A and 121B by a length equal to twice the length of the cranks 121A and 121B, that is, equal to the diameter of the arc. As a result of such movement, the sliding door 116 provided on the bracket 114 can be engaged with the sliding door supporting rail 118. At the engaging position, the opening and closing driving section 120 which can be engaged with the driven roller 119 formed on the bracket 114** is disposed.

A grooved portion 122 is formed at the lower end of the sliding door 109B. A sliding door supporting rod 123 for engaging with the grooved portion 122 is disposed for movement in a hole portion **111*a* provided on the floor 111. Pivotal ends of cranks 124A and 124B are connected to upper and lower shaft portions 123*a* and 123*b* of the sliding door supporting rod 123 so that the sliding door supporting rod 123 can be shifted between the stationary fixed position of the sliding door and the shifted position of the sliding door similarly to the sliding door hanger 117. When the cranks 124A and 124B are pivoted by 180 degrees drawing arcs centered at the pivotal center shafts 124*a* and 124*b*, the sliding door 109B is moved, by the sliding door supporting rod 123 which maintains its posture, from the position shown to the sliding door shifted position at which a rail 125 is positioned. Consequently, the grooved portion 122 of the sliding door 109A is placed onto the rail 125. The rail 125 is provided on the floor 111 and serves as a guide portion for opening and closing the sliding door 109A together with the sliding door supporting rail 118**.

The condition wherein the sliding door 109A is shifted from the stationary fixed position of FIG. 4 to the shifted position in order to open or close the sliding door 109A is shown in FIG. 5. When the upper cranks 121A and 121B and the lower cranks 124A and 124B are pivoted by 180 degrees in a synchronized relationship with each other from the condition shown in FIG. 4, the sliding door 109A supported on the sliding door hanger 117 is shifted to the shifted position disposed in an approaching direction to the platform edge of the platform and the door roller 116 provided on the bracket 114 is engaged with and supported by the sliding door supporting rail 118. In this instance, the lower side of the sliding door 109A is placed onto the rail 125 on the floor by the sliding door supporting rod 123. The upper and lower cranks 121 and 124 have a construction wherein they can be synchronized with each other by mechanical or electrical means.

When the sliding door 109A is moved to the position of FIG. 5, the opening and closing driving section 120 disposed at the alternate long and short dash line position is moved to its solid line position at which it engages with the driven roller 119. As a result of the driving of the opening and closing driving section 120, the sliding door 109A is opened and closed by way of the driven roller 119.

Figure 6:
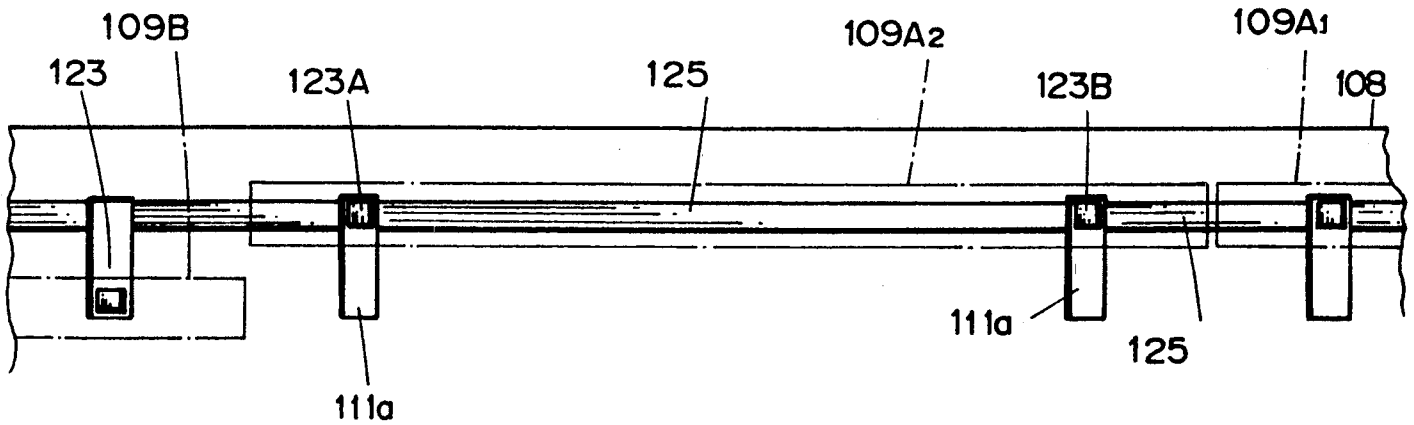
FIG. 6 is a plan view showing a relationship between a rail of a shifting apparatus at a lower portion of a sliding door and a sliding door supporting rod in FIG. 5.

FIG. 6 is a plan view showing a lower portion of the sliding door in FIG. 5, that is, a portion of the sliding door around the rail 125 and the sliding door supporting rod 123. In the present drawing, the sliding door 109A, and the sliding door $109A_2$ are on the rail 125 near the platform edge 108 and are in positions in which they can be opened and closed. The sliding door 109B is disposed at its stationary fixed position spaced away from the platform edge 108. Each of the sliding doors is constructed such that, as shown with the sliding door $109A_2$, it is supported on the sliding door supporting rods 123A and 123B at portions adjacent the opposite longitudinal ends thereof. The hole portions **111*a* are formed in the floor so that the sliding door supporting rods 123A and 123B may move. Upper ends of the sliding door supporting rods 123A and 123B are positioned at rail portions corresponding to the hole portions 111*a* so as to fill up the rail portions lacking due to the hole portions 111*a*. It is to be noted that, while the sliding door supporting rods 123 of the sliding door 109B at the stationary fixed position are not positioned at the lacking rail portions, since the grooved portions 122** formed on the sliding door are long, the lacking of the rail portion does not cause trouble in opening and closing the sliding door.

Figure 7:
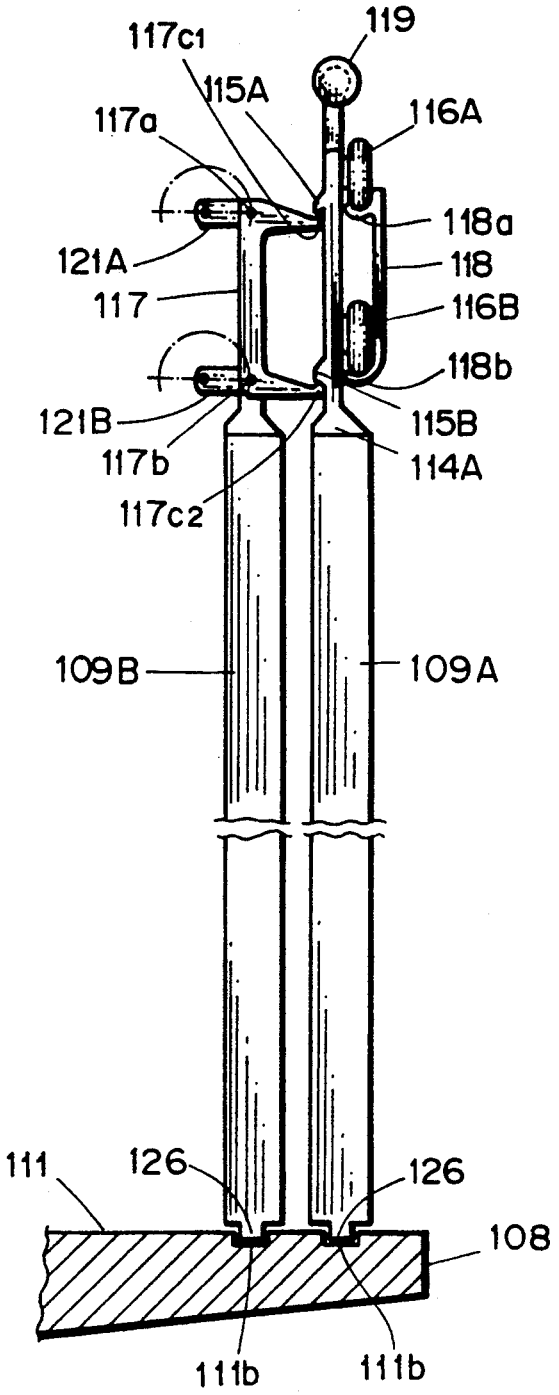
FIG. 7 shows in vertical sectional view another embodiment of a sliding door shifting apparatus of the present invention.

FIG. 7 shows another embodiment different from the sliding door shifting apparatus shown in FIGS. 4 and 5. In the present embodiment, the sliding door supporting rod provided at the lower portion of the sliding door is unnecessary. In FIG. 7, a sliding door at its stationary fixed position is indicated by 109B while the sliding door at its shifted position is indicated by 109A. The condition wherein the sliding door 109A is shifted to the shifted position by a sliding door hanger 117 is shown.

In the present embodiment, a pair of door rollers 116A and 116B and a pair of hooks 115A and 115B are disposed in a vertically spaced relationship at a fixed distance from each other on a bracket 114A formed on the sliding door 109A. A sliding door supporting rail 118 which supports the two door rollers 116A and 116B thereon has two upper and lower arresting portions **118*a* and 118*b*. A sliding door hanger 117 for supporting the two hooks 115A and 115B** thereon has two arresting portions $117c_1$ and $117c_2$.

Due to this construction, the sliding door 109A can be shifted stably from the stationary fixed position to the shifted position and can be opened and closed at the shifted position only relying upon the support at the upper portion thereof.

Operation of each sliding door is basically similar to that of the embodiment described above. Shifting movement from the stationary fixed position to the shifted position proceeds such that the sliding door hanger 117 is engaged, by pivotal motion of cranks 121A and 121B, with the hooks 115A and 115B at the two locations to shift the sliding door 109A to the shifted position to the sliding door supporting rail side to engage the two door rollers 116A and 116B with the arresting portions **118*a* and 118*b* of the sliding door supporting rail 118, respectively. At a lower portion of the sliding door 109A, a downwardly directed projection 126 is formed at a lower face of the sliding door. Projection 126 is engaged with a guide groove 111*b* formed on a floor 111**.

Since the sliding door 109A in the present embodiment can be supported stably at the upper portion thereof in this manner, the lower portion of the sliding door 109A is sufficient if it only includes a simple construction which performs mere positioning.

Figure 8:
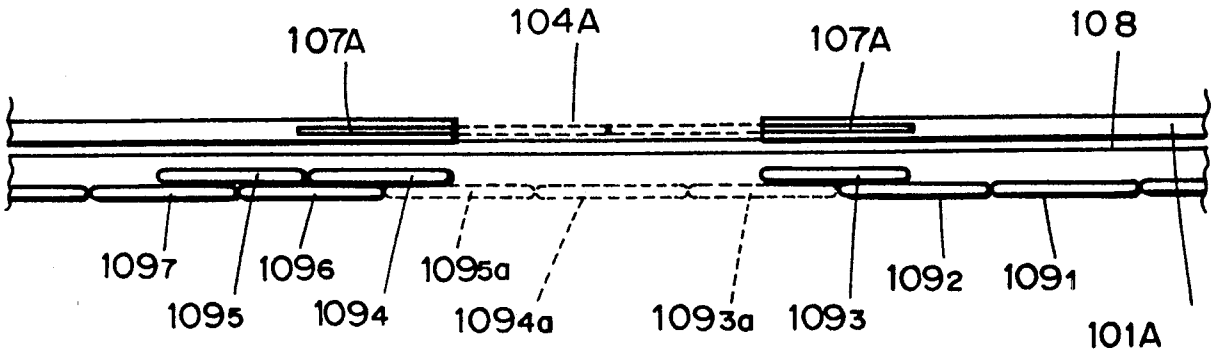
FIG. 8 is a plan view illustrating a relationship between an entrance of a vehicle and sliding doors.

FIG. 8 is a plan view showing an open condition of sliding doors in case the width of an entrance 104A of a vehicle 101A is greater than the width of two sliding doors 109 on the platform side.

The sliding doors are denoted by $\mathbf{109}_1$ to $\mathbf{109}_7$. Sliding doors $\mathbf{109}_3$, $\mathbf{109}_4$ and $\mathbf{109}_5$ are shifted from the condition of stationary fixed positions (positions of $\mathbf{109}_{3a}$, $\mathbf{109}_{4a}$ and $\mathbf{109}_{5a}$ indicated by broken lines) to respective shifted positions on the supporting rail side near platform edge 108. Sliding door $\mathbf{109}_3$ is moved to the right side while the sliding doors $\mathbf{109}_4$ and $\mathbf{109}_5$ are moved to the left side to form an opening which coincides with the entrance 104A of the vehicle. Reference character 107A denotes a sliding door of the double sliding type.

Figure 9:
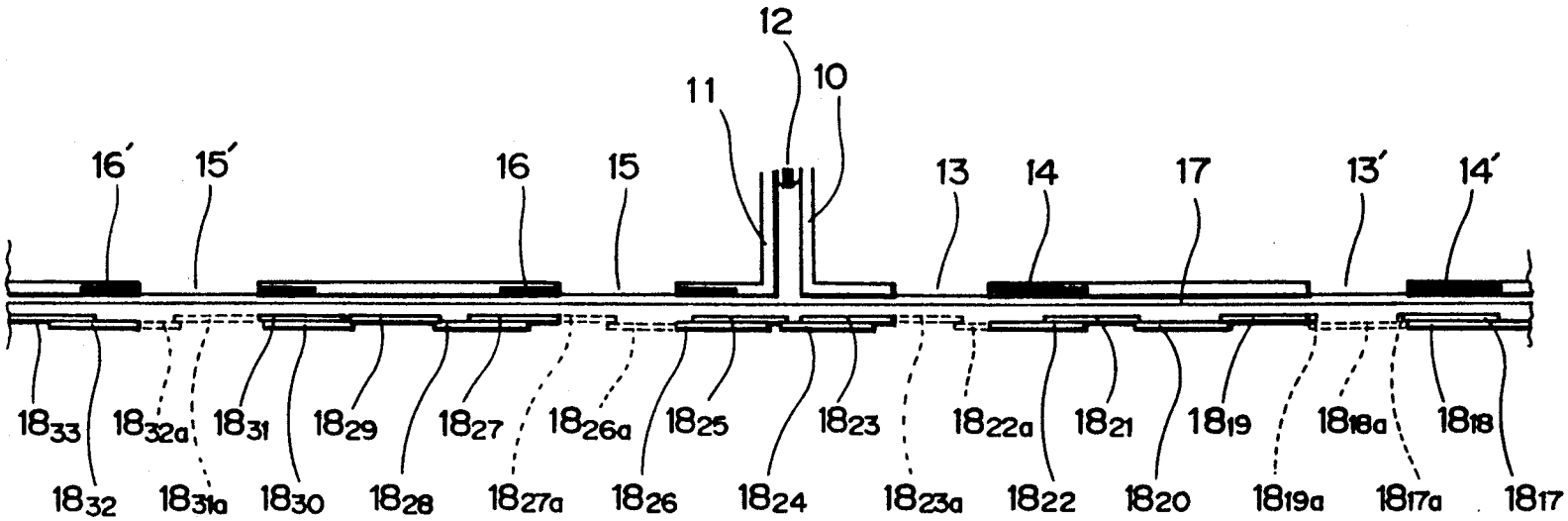
FIG. 9 is a plan view showing another embodiment of a sliding door apparatus different from the sliding door apparatus of FIGS. 2 and 3.
Figure 10:
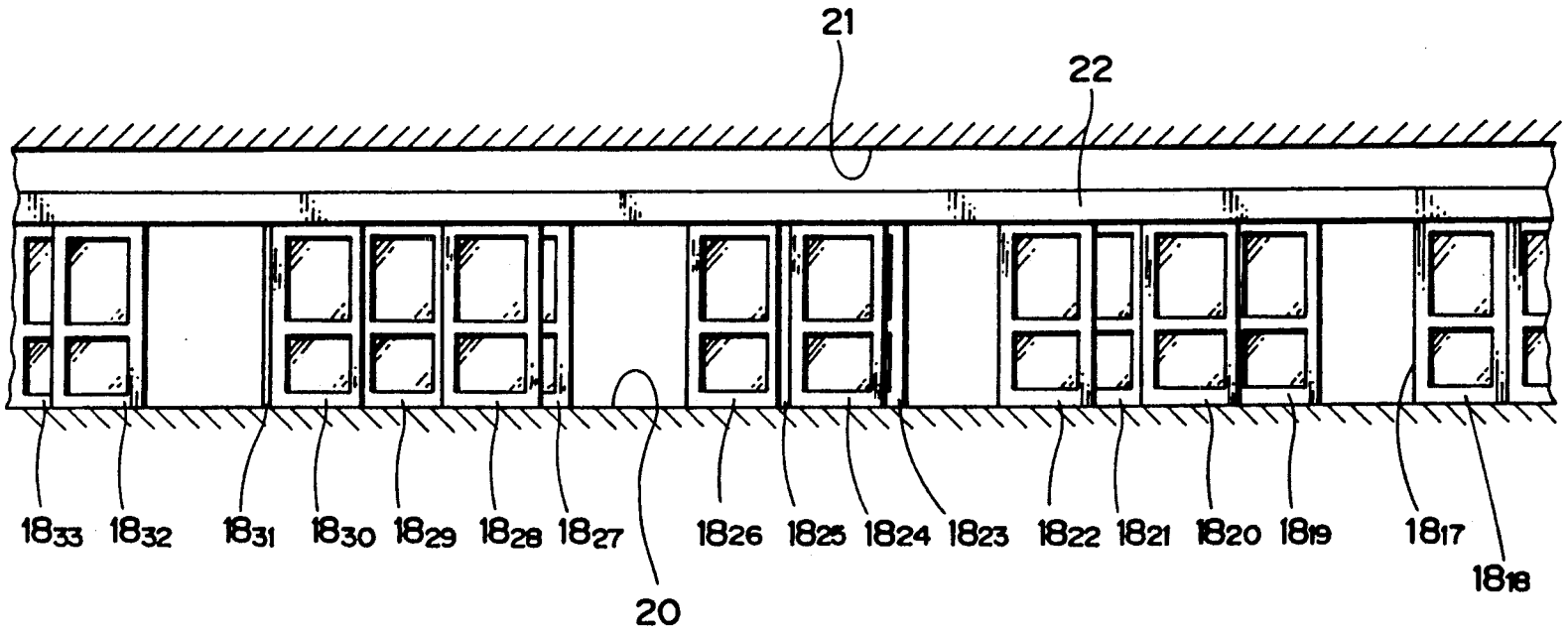
FIG. 10 is a side elevational view of the sliding door apparatus of FIG. 9.
Figure 11:
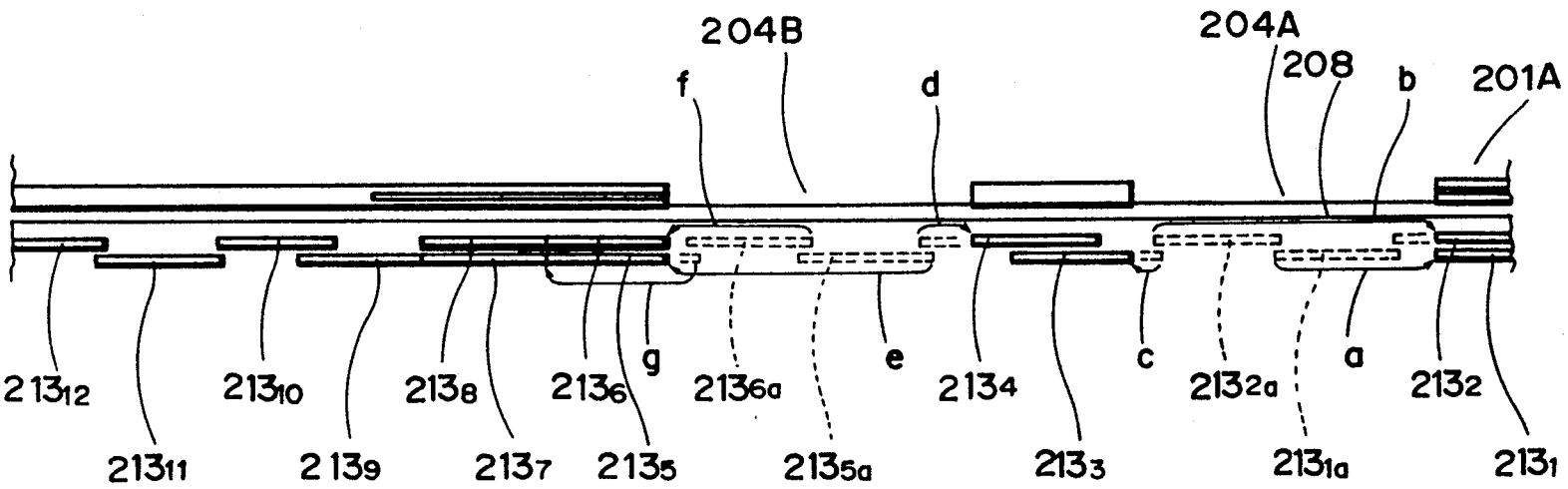
FIG. 11 is a plan view of the sliding door apparatus showing a moved condition of sliding doors where two entrances of a vehicle are provided close to each other.

FIGS. 9 to 11 show an arrangement of a sliding door apparatus based on a door opening and closing driving apparatus of another embodiment shown in FIG. 12 which will be hereinafter described. In the present embodiment, sliding doors are disposed at fixed positions in two rows parallel to a platform edge. The odd-numbered sliding doors are disposed in one of the rows and the even-numbered sliding doors are disposed in the other row such that they are disposed alternately to present a closed condition. The sliding doors at a position conforming with an entrance are moved in predetermined directions by predetermined stroke amounts by the door opening and closing driving apparatus.

FIG. 9 corresponds to FIG. 2 while FIG. 10 corresponds to FIG. 3, and like reference characters are applied to like portions. Referring to FIG. 9, reference numerals 10 and 11 each denote a vehicle. The vehicles 10 and 11 are coupled to each other by means of a coupler 12 to constitute a train. A pair of entrances 13 and 13' are formed on the vehicle 10. A pair of sliding doors 14 and 14' of the single sliding type are disposed at the entrances 13 and 13' such that they may open and close the entrance doors 13 and 13'. At solid line positions shown in FIG. 9, the sliding doors 14 and 14' are in a condition in which they open the entrance doors 13 and 13'. Entrances 15 and 15' of railway vehicle 11 are of different widths from those of the railway vehicle 10 and accordingly are provided with sliding doors 16 and 16' of the double sliding type.

Reference numeral 17 denotes a platform edge of a platform. Sliding doors $\mathbf{18}_{17}$ to $\mathbf{18}_{24}$ and $\mathbf{18}_{25}$ to $\mathbf{18}_{33}$ are disposed continuously in two rows along the platform edge 17. Of the sliding doors, those sliding doors $\mathbf{18}_{17}$, $\mathbf{18}_{19}$, $\mathbf{18}_{21}$, and so forth which have odd-numbered suffixes are supported on a sliding door supporting rail adjacent the platform edge 17 while the even-numbered sliding doors $\mathbf{18}_{18}$, $\mathbf{18}_{20}$, $\mathbf{18}_{22}$ and so forth are supported on another sliding door support rail remote from the platform edge 17. The sliding doors arranged alternately at fixed positions in two rows in this manner are positioned in a closed condition except when a railway vehicle stops at the platform. In the drawings, each sliding door which contributes to an opening action is indicated by a broken line when it is at its closed position and such sliding doors are indicated by $\mathbf{18}_{17a}$, $\mathbf{18}_{18a}$, $\mathbf{18}_{19a}$.

For the entrance 13, the sliding door $\mathbf{18}_{22a}$ is moved rightwardly to the sliding door $\mathbf{18}_{22}$ while the sliding door $\mathbf{18}_{23a}$ is moved leftwardly to the sliding door $\mathbf{18}_{23}$. Meanwhile, for the other entrance 13', the sliding door $\mathbf{18}_{17a}$ is moved rightwardly a little to the sliding door $\mathbf{18}_{17}$ and the sliding door $\mathbf{18}_{18a}$ is moved rightwardly by a great distance to the sliding door $\mathbf{18}_{18}$ while the sliding door $\mathbf{18}_{19a}$ is moved leftwardly a little to the sliding door $\mathbf{18}_{19}$, thereby opening the sliding doors at the closed fixed positions in conformity with the railway vehicle's entrances. For the entrances 14 and 14', the sliding doors corresponding to them can be opened similarly in conformity with the entrances.

While the sliding doors in the present embodiment are disposed continuously in two rows along the platform edge 17 of the platform such that they are all movable, it is also possible to dispose a fixed wall at a position of the platform edge which does not correspond to an entrance when a train of any type stops, for example, at the position corresponding to the sliding door $\mathbf{18}_{24}$ in FIG. 9. Further, while it is described that, in the embodiment, an opening which conforms to the magnitude of an entrance of a vehicle is formed, an opening a little wider than an entrance of a vehicle may be formed by controlling the movement of the sliding doors.

FIG. 10 shows side faces of the sliding doors of FIG. 9, and the sliding doors are in an open condition. Reference numeral 20 denotes a floor of the platform, 21 a ceiling, and 22 a door header. Supporting sections for the sliding doors and door opening and closing driving apparatus are accommodated in the inside of the door header 22.

While the sliding doors are provided on the two rows of sliding door supporting rails and an opening is formed by selected sliding doors in the embodiment described above, it is also possible to dispose, in addition to the first sliding door supporting rail and the second sliding door supporting rail, a third sliding door supporting rail such that, upon opening and closing of the sliding doors, an opening is set by opening and closing of the sliding doors by the second sliding door supporting rail and the third sliding door supporting rail. This can be put into practice when opening and closing of the sliding doors on the first sliding door supporting rail is difficult from the construction of the platform.

FIG. 11 shows an embodiment as regards opening and closing of sliding doors when two entrances 204A and 204B of a vehicle are provided close to each other. In particular, the entrances 204A and 204B are formed close to each other on a vehicle 201A. Corresponding to this, the width of the sliding doors is set smaller than the width of a minimum wall positioned between the adjacent entrances. As a result, the number of sliding doors to be moved is increased in order to form an opening conforming with the wider entrance.

The fact that sliding doors $213_1$ to $213_{12}$ are supported in two rows on sliding door supporting rails is similar to that of FIG. 9. In the drawing, a condition of closed fixed positions before movement is indicated by a broken line and by the suffix added to a reference numeral whereas an open condition after movement is indicated by a solid line. Movement of the sliding doors from the condition of its closed fixed position to its open condition is indicated by arrow marks a to g. For example, when, of the odd-numbered sliding doors supported on the sliding door supporting rail of one row (supporting rail positioned at a lower portion in the drawing), the sliding door $213_{5a}$ is opened and moved to the sliding door $213_5$ by a stroke of the arrow mark e, the sliding doors $213_{7a}$ and $213_{9a}$ are also moved simultaneously to the positions indicated by the sliding doors $213_7$ and $213_9$ by a stroke of the arrow mark g. As regards the even-numbered sliding doors supported on the sliding door supporting rail of the other row (supporting rail positioned at an upper portion in the drawing), when the sliding door $213_{6a}$ is opened, the adjacent sliding door $213_8$ is simultaneously moved similarly.

Figure 12:
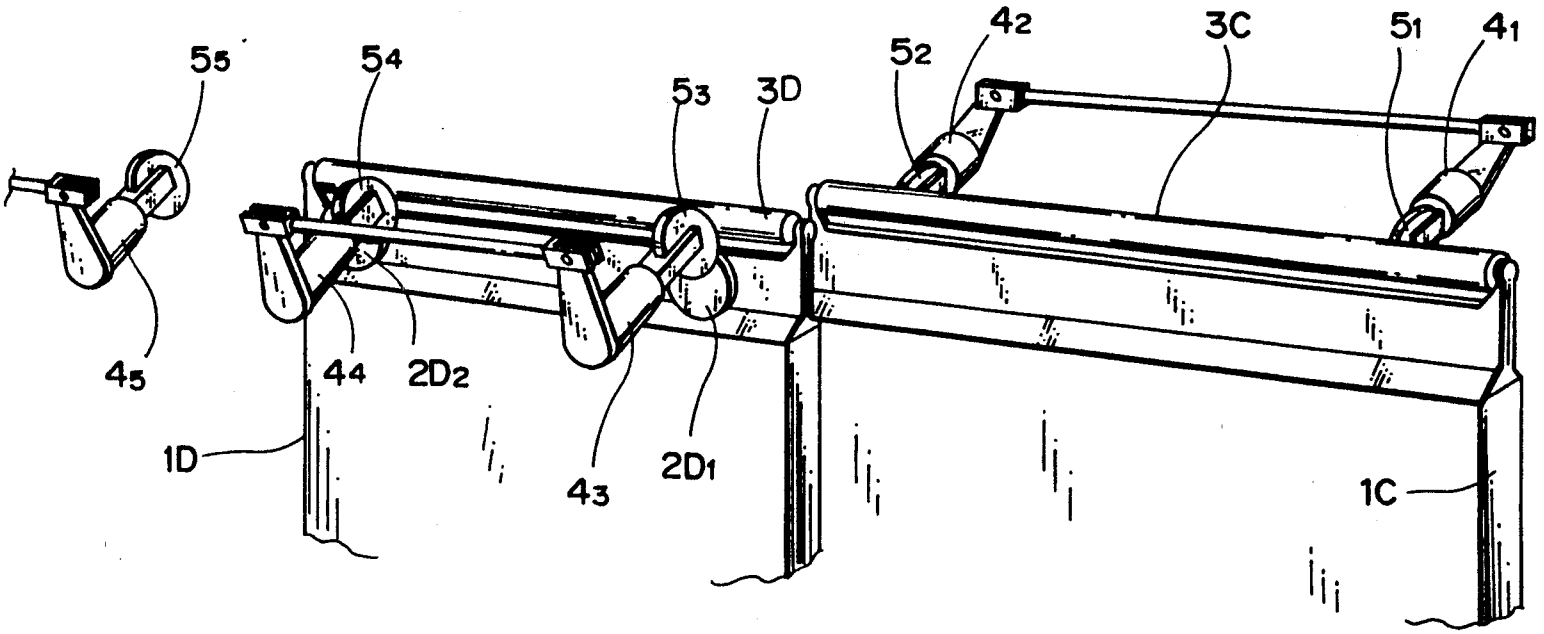
FIG. 12 shows in perspective view another opening and closing driving apparatus of the present invention which can be applied to the sliding door apparatus shown in FIGS. 9 to 11.

In FIG. 12, an embodiment of a door opening and closing driving apparatus is illustrated wherein adjacent sliding doors are disposed alternately at closed fixed positions in two rows. In FIG. 12, two adjacent sliding doors 1C and 1D to be opened are arranged in two rows at the closed fixed positions. Similarly as in the case of FIG. 1, a pair of door rollers $2D_1$ and $2D_2$ (door rollers of the sliding door 1C are not shown) are mounted on a bracket provided at an upper position of each of the sliding doors 1C and 1D. Each of the door rollers $2D_1$ and $2D_2$ is placed on a sliding door supporting rail (not shown) such that the sliding doors 1C and 1D can be opened when a rightward or leftward force is applied to the sliding doors 1C and 1D by an action of the door opening and closing driving apparatus.

In the condition shown, a driven roller 3C is disposed at an end of the bracket provided at the upper portion of the sliding door 1C. A pair of driving rollers $5_1$ and $5_2$ of door opening and closing driving sections $4_1$ and $4_2$ are engaged with a driven roller 3C so that, when the driving rollers $5_1$ and $5_2$ rotate, the sliding door 1C is moved to the right side of the axial direction of the driven roller $3_1$ due to intersecting angles set to the driving rollers $5_1$ and $5_2$. Simultaneously, a driven roller $3_2$ of the sliding door 1D and driving rollers $5_3$ and $5_4$ of door opening and closing driving sections $4_3$ and $4_4$ are engaged with each other so that, when the driving rollers $5_3$ and $5_4$ rotate, the sliding door 1D is moved to the left side of the axial direction of the driven roller $3_2$ due to intersecting angles set to the driving rollers $5_3$ and $5_4$. When the sliding door 1D is moved in the leftward direction, the sliding door 1D is disengaged from the door opening and closing driving section $4_3$ but is engaged with another door opening and closing driving section $4_5$ so that it is provided with a greater leftward stroke amount.

The movement of the sliding doors 1C and 1D is such that the door opening and closing driving sections $4_1$ and $4_5$ are controlled in response to positions and magnitudes of entrances to form predetermined openings. The door opening and closing driving sections are disposed continuously while the pitch between the two door opening and closing driving sections $4_1$ and $4_2$or $4_3$ and $4_4$ is made smaller than the length of each driven roller. Consequently, feeding a continuous long stroke amount can be permitted.

Figure 13:
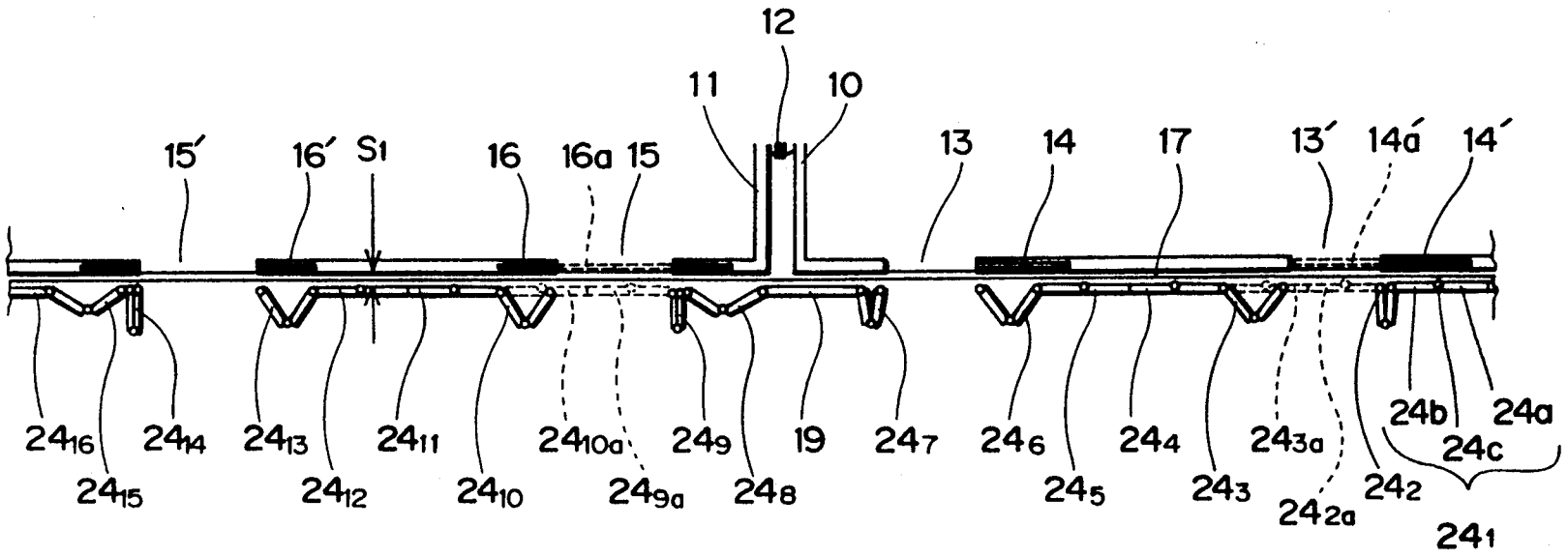
FIG. 13 is a plan view showing an embodiment wherein an opening and closing driving apparatus of the present invention is applied to a folding door apparatus.
Figure 14:
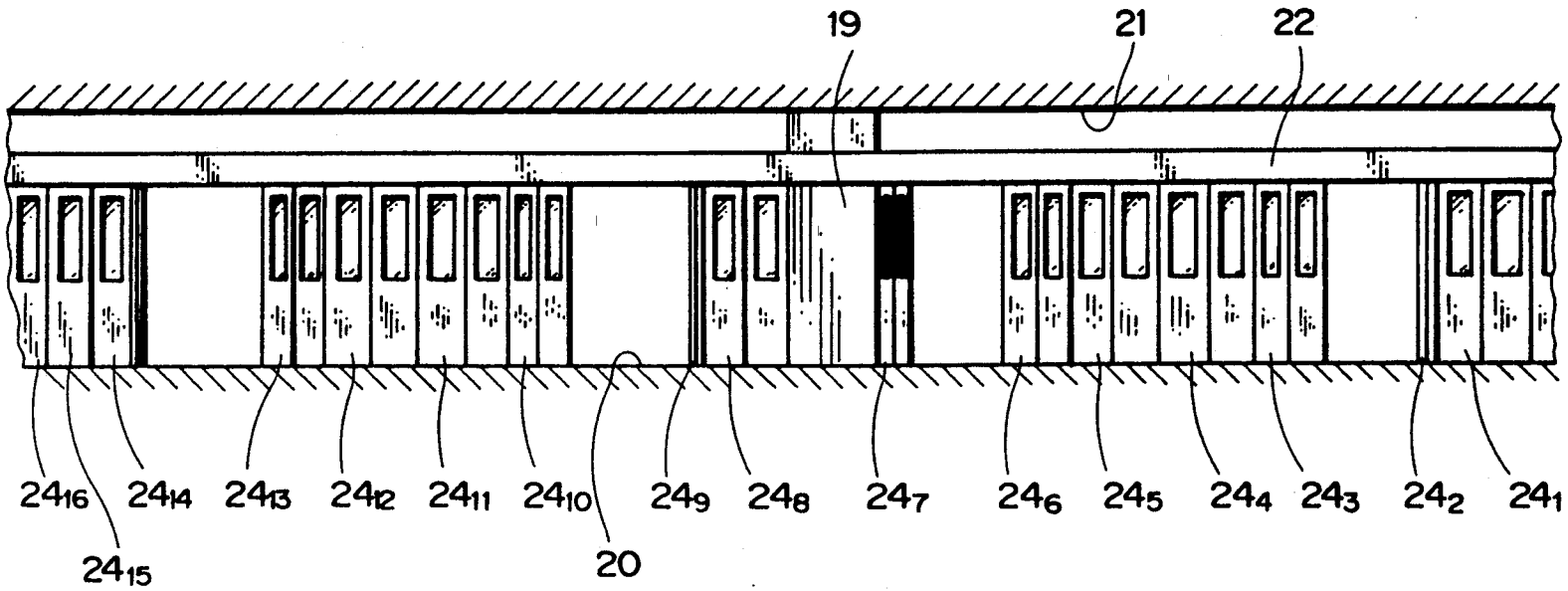
FIG. 14 is a side elevational view of the folding door apparatus shown in FIG. 13.

FIGS. 13 and 14 illustrate in plan view and side elevational view a relationship to railway vehicles when folding doors are employed as a door apparatus in a door opening and closing driving apparatus of the present invention. Referring to FIG. 13, reference numerals 10 and 11 each denote a vehicle. The vehicles 10 and 11 are coupled to each other by means of a coupler 12 to constitute a train. A pair of entrances 13 and 13' are formed on the vehicle 10. A pair of sliding doors 14 and 14' of the single sliding type are disposed at the entrances 13 and 13' such that they may open and close the entrance doors 13 and 13'. At solid line positions shown in FIG. 13, the sliding doors 14 and 14' are in a condition in which they open the entrance doors 13 and 13'. The sliding door 14' indicated by a broken line shows a condition wherein it closes the entrance 13'. Entrances 15 and 15' of the vehicle 11 are of different widths than those of the railway vehicle 10 and accordingly are provided with sliding doors 16 and 16' of the double sliding type.

Reference numeral 17 denotes a platform edge of a platform. Folding doors $24_1$ to $24_7$ and $24_8$ to $24_{16}$ are disposed continuously in a serial row along the platform edge 17. In the drawing, the folding doors in a closed condition are provided with the suffix a, such as $24_{2a}$, $24_{3a}$, $24_{9a}$ and $24_{10a}$, and are indicated by broken lines. The folding doors in such closed condition are arranged in a straight line and the positions of the folding doors will be hereinafter referred to as stationary fixed positions. Upon opening the folding doors, the folding doors to be moved in order to form openings are driven in predetermined directions by predetermined stroke amounts to the solid line positions (having no suffix) so as to form openings registered with the entrances 13, 13', 15 and 15' of the vehicles.

Each of the folding doors $24_1$ to $24_7$ and $24_8$ to $24_{16}$ is constructed such that it is composed of a set of elements 24*a* and 24*b*. A joining point between the set of elements 24*a* and 24*b* is made an inflecting point 24*c* as shown at the folding door $24_1$ as an example. The folding doors $24_6$ and $24_7$ are positioned corresponding to the entrance 13 of the vehicle 10. Similarly, the folding doors $24_2$ and $24_3$ are positioned corresponding to the entrance 13'. As the individual folding doors are inflected at the inflecting points 24*c*, they are moved leftwardly and rightwardly so as to conform with the openings of the entrances. Meanwhile, the folding doors $24_9$ and $24_8$ which can be moved in the rightward direction and the folding door $24_{10}$ which can be moved in the leftward direction are positioned corresponding to the entrance 15 of the vehicle 11. Similarly, the folding door $24_{13}$ which can be moved in the rightward direction and the folding doors $24_{14}$ and $24_{15}$ which can be moved in the leftward direction are positioned corresponding to the entrance 15'.

Of the two folding doors $24_9$ and $24_8$ which are moved in the rightward direction with respect to the entrance 15, the folding door $24_9$ on the opening end side is first inflected around the inflecting point 24*c* until inner faces of the set of elements 24*a* and 24*b* are contacted with each other. Further, movement of the folding door $24_9$ in the rightward direction inflects the adjacent folding door $24_8$ around the inflecting point 24*c* in accordance with the amount of movement. Similarly, operations of the two folding doors $24_{14}$ and $24_{15}$ which are moved in the leftward direction with respect to the entrance 15' are similar. In this manner, openings conforming to the opening dimensions of vehicle entrances can be set by the folding doors.

A fixed wall 19 is disposed in a common plane with the folding doors between the folding doors $24_7$ and $24_8$. The fixed wall 19 is at a location which corresponds to a connecting portion of a train and normally is free from an entrance. Consequently, there is no necessity of providing a folding door there.

While, in the embodiment of the present invention described so far, openings equal to the sizes of the entrances described above are formed by inflecting movement of the folding doors at the positions of the entrances of the vehicles, it is also possible to provide openings wider than the entrances by controlling the movement of the folding doors.

FIG. 14 is a side elevational view of FIG. 13 and shows a condition wherein the folding doors are open. Reference numeral 20 denotes a floor of the platform, 21 a ceiling and 22 a door header. Supporting sections and opening and closing driving mechanisms for the folding doors are accommodated in the inside of the door header 13.

While a predetermined opening is obtained in the embodiment of the present invention described above by inflecting, when an opening is to be formed, the folding doors are disposed in a serial row along the platform so as to form a concave shape with respect to a side face of a vehicle. In an embodiment of the present invention shown in FIGS. 15, 16 and 17, folding doors are inflected, by force applied to those folding doors positioned at opening ends, around the inflecting point 24*c* of a set of elements 24*a* and 24*b* of each folding door in a direction in which they approach a side face of a vehicle to form an opening corresponding to an entrance.

Figure 15:
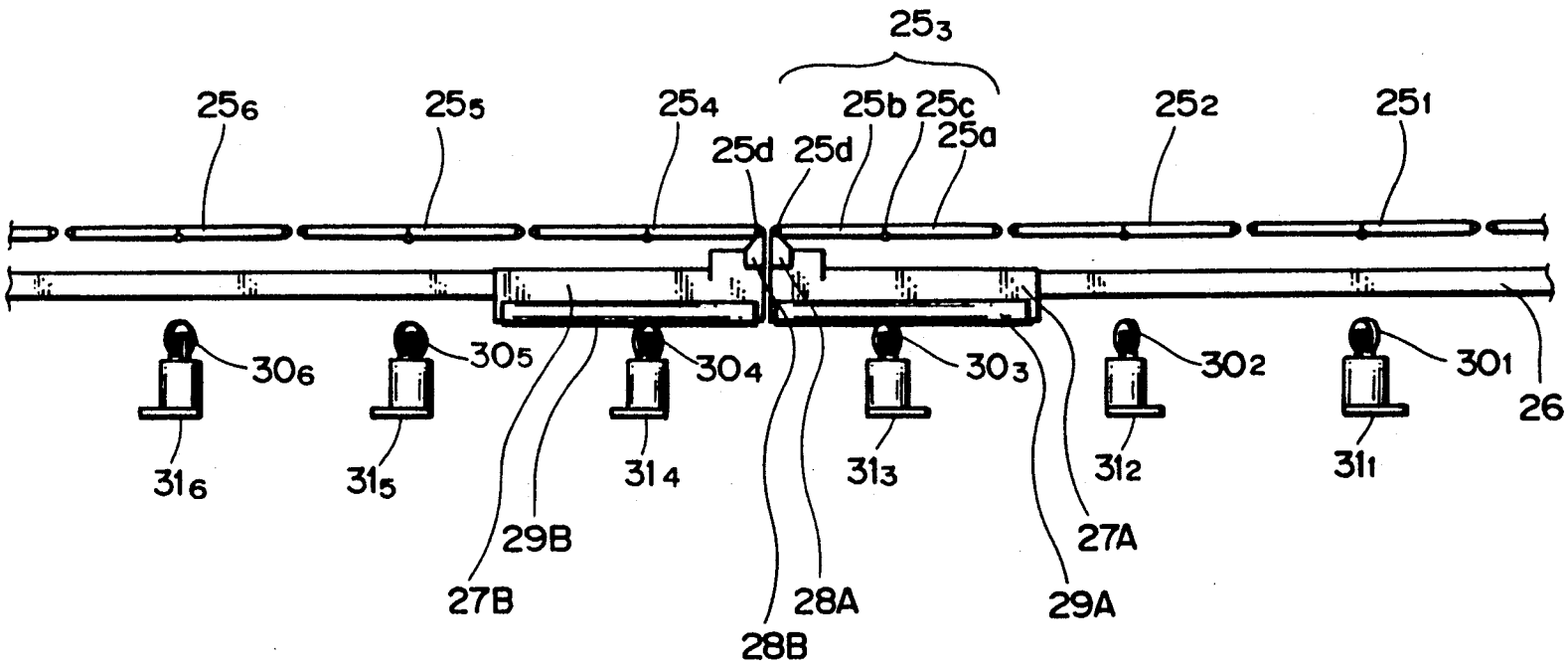
FIG. 15 illustrates in plan view a relationship between a folding door apparatus and an opening and closing driving apparatus of the present invention and shows a condition wherein the opening and closing driving apparatus is disposed at a position of folding doors to be opened and closed.
Figure 16:
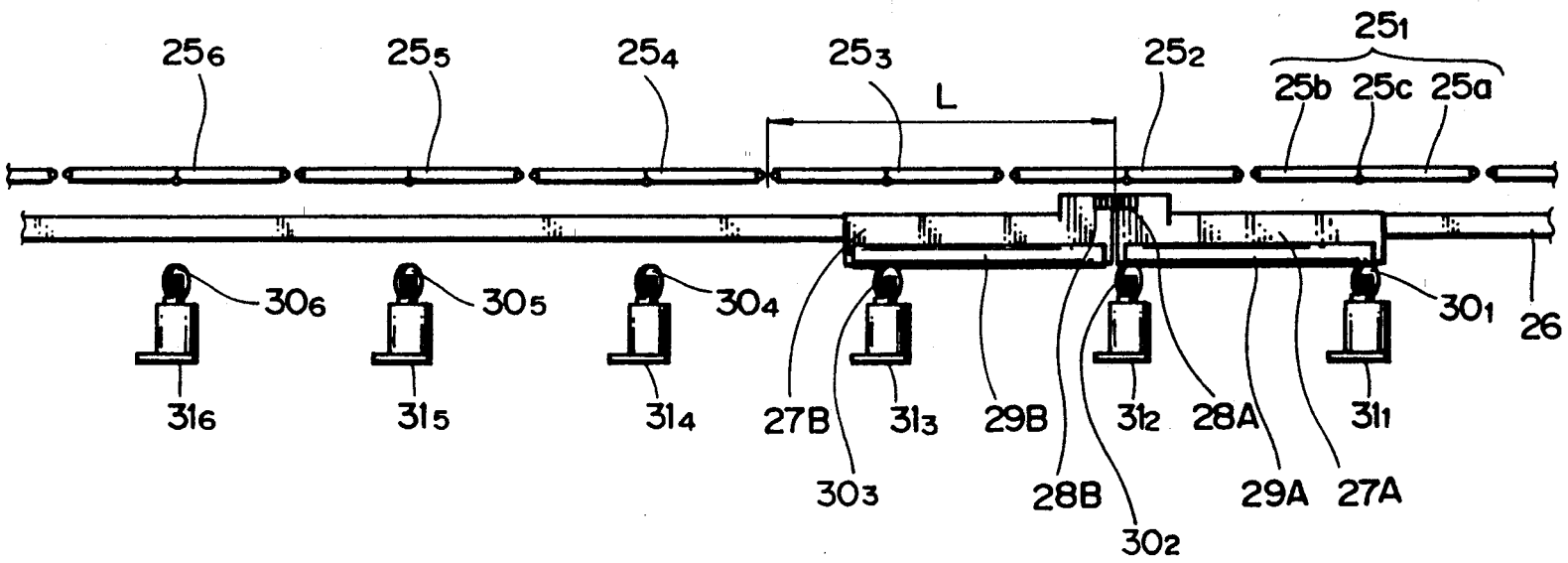
FIG. 16 is a plan view showing a condition before the opening and closing driving apparatus of the present invention selects a particular folding door of the folding door apparatus.
Figure 17:
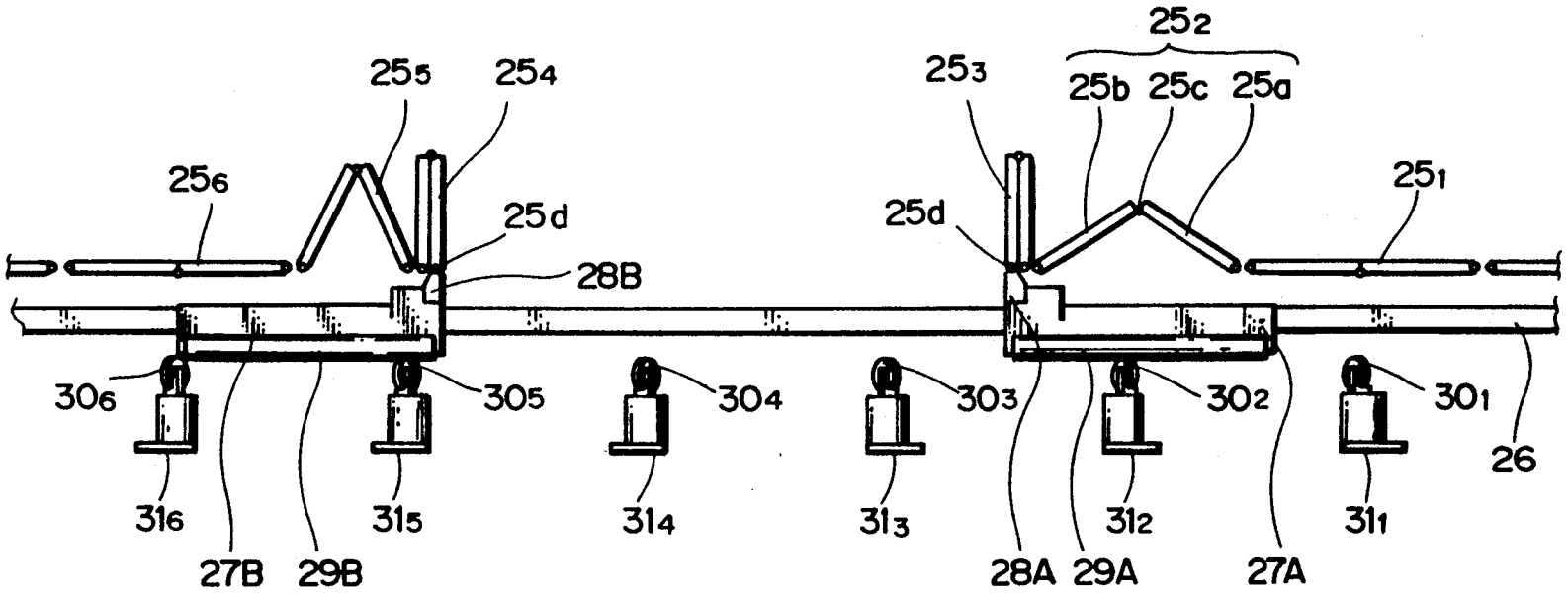
FIG. 17 shows a plan view showing a condition wherein the opening and closing driving apparatus of the present invention opens the folding door apparatus from the condition of FIG. 15.

An embodiment of an opening and closing driving apparatus for folding doors of the present invention is shown in FIGS. 15 to 17 (plan views). A condition of the opening and closing driving apparatus for folding doors before starting its operation is shown in FIG. 16. Another condition of the opening and closing driving apparatus immediately before the folding doors are opened is shown in FIG. 15. A relationship between the folding doors forming an opening and the opening and closing driving apparatus is illustrated in FIG. 17.

Folding doors $25_1$ to $25_6$ are positioned in parallel to a platform edge 8A of a platform and hold the positions corresponding to an entrance in a closed condition. An opening end of the plurality of folding doors is between the folding doors $25_3$ and $25_4$. As the folding doors $25_3$ and $25_4$ are opened and closed leftwardly and rightwardly, the folding doors are opened and closed.

The opening and closing driving apparatus for folding doors is provided with a supporting rail 26 in parallel to the folding doors in the serial arrangement in the closed condition for opening and closing the folding doors. Two opening and closing acting bodies 27A and 27B are disposed for individual movement in leftward and rightward directions on the supporting rail 26. Each of the opening and closing acting bodies 27A and 27B is provided on the folding doors side with engaging elements 25A and 25B for engaging with a door end 25*d* of the folding door $25_3$ at the opening end as well as a door end 25*d* of the folding door $25_4$, respectively, and is provided on the opposite side of the folding doors with driven rollers 29A and 29B adapted to move the opening and closing acting bodies 27A and 27B and mounted in an integrated condition.

For the driven rollers 29A and 29B provided on the opening and closing acting bodies 27A and 27B, opening and closing driving sections $31_1$ to $31_6$ having driving rollers $30_1$ to $30_6$ acting with intersecting angles upon the driven rollers 29A and 29B are disposed. The distance between each of the adjacent plurality of opening and closing driving sections is set shorter than the length L of the driven rollers 29A and 29B provided on the opening and closing acting bodies 27A and 27B. The opening and closing driving sections $31_1$ to $31_6$ have a construction which can change the intersecting angles of the respective driving rollers $30_1$ to $30_6$.

In the opening and closing driving apparatus for folding doors of the present invention described so far, the driving rollers $30_3$ and $30_4$ are first rotated by operation of the opening and closing driving section $31_3$ and the opening and closing driving section $31_4$. Consequently, the opening and closing acting body 27A is moved to the right side while the opening and closing acting body 27B is moved to the left. By such movements, the folding doors $25_3$ and $25_4$ are first inflected by way of the engaging elements 28A and 28B so that the folding doors are moved in the opening direction. The intersecting angels of the driving rollers are set in the opposite directions at the opening and closing driving sections $31_1$ to $31_3$ and $31_4$ to $31_6$. With respect to the boundary between the folding door $25_3$ and the folding door $25_4$, the folding door $25_3$ is moved rightwardly while the folding door $25_4$ is moved leftwardly. By setting the intersecting angles of the driving rollers opposite to each other, the folding doors thus opened can be moved in the closing direction.

Naturally, the directions of movement of the folding doors can be changed by way of the opening and closing acting bodies by rotating the driving rollers 30 forward or in reverse. Consequently, the folding doors can be opened and closed by changing the directions of rotation of the driving rollers without changing the intersecting angles of the driving rollers at the opening stroke and the closing stroke of the folding doors.

Thus, in order to open the folding doors between the folding door $25_3$ and the folding door $25_4$ from a relationship to an entrance of a track vehicle, the opening and closing acting bodies 27A and 27B at the position of FIG. 16 are moved to the left by a distance of L. Thereupon, the opening and closing driving sections $31_1$ to $31_4$ are all operated in the leftwardly feeding condition, and the opening and closing acting bodies 27A and 27B are moved by the distance L. Next, the engaging element 28A and 28B are engaged with the door ends 25*d* of the folding doors $25_3$ and $25_4$ positioned at the opening ends as shown in FIG. 15 to change the intersecting angles of the driving rollers $30_1$ to $30_3$ of the opening and closing driving sections $25_1$ to $25_3$ into the rightward feeding direction, thereby completing preparations for opening of the folding doors.

The folding doors with which preparations for opening are completed as shown in FIG. 15 are then put into such an open condition as shown in FIG. 17 because the opening and closing acting body 27A starts its movement by the opening and closing driving section $25_3$ in order to form a predetermined opening. The folding doors undergo action of both of the opening and closing driving sections $31_3$ and $31_2$ due to the fact that the length of the driven roller 29A is set longer than the distance between two adjacent opening and closing driving sections. The opening and closing acting body 27B undergoes similar action, and an open condition shown is reached.

Figure 18:
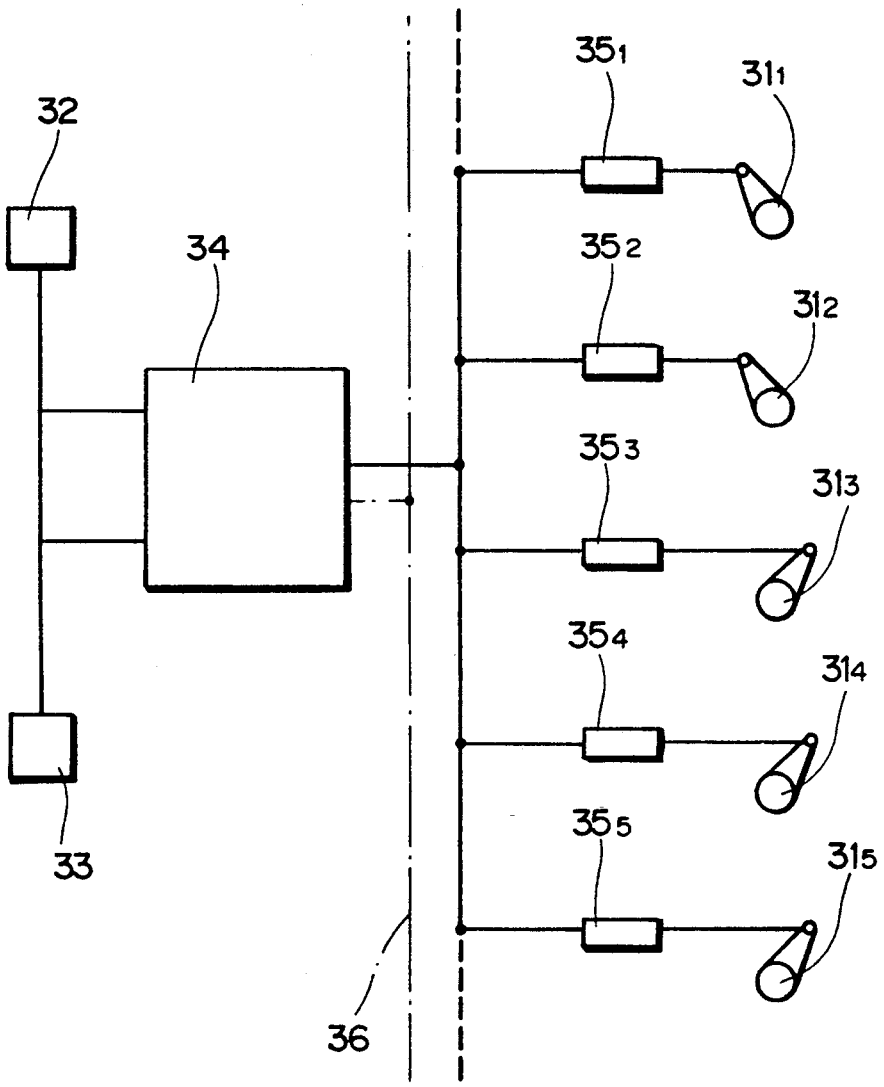
FIG. 18 is a circuit diagram for controlling an opening and closing operating section in the present invention.

A circuit diagram for controlling the opening and closing driving sections in response to information concerning the entrances of a railway vehicle is shown in FIG. 18. From a railway vehicle, information 32 regarding positions and widths of entrances of the vehicle and information 33 regarding a position at which the vehicle stops are obtained. The two pieces of information 32 and 33 are transmitted to a logic unit 34. The logic unit 34 controls the opening and closing driving sections described above to move the folding doors to their open positions. In this instance, the logic unit 34 determines if openings corresponding to entrances of the railway vehicle can be set "in which directions" and "by what amounts" and how "the folding doors at which positions" are to be moved, and controls the individual actuators $35_1$ to $35_2$ so that intersecting angles of the opening and closing driving sections $31_1$ to $31_5$ may be obtained in accordance with the determination. While the two opening and closing driving sections are operated by the single actuator in FIG. 1, it is also possible to construct the device such that one opening and closing driving section is operated by one actuator as shown in FIG. 18.

The logic unit 34 also has a function of outputting, when it determines how "the sliding doors at which positions" should be moved, a shifting instruction to a control line 36 in order to shift, in accordance with the setting, the sliding doors from their stationary fixed positions to their shifted positions on the sliding door supporting rail. It is to be noted that a microcomputer or the like may be used as the logic unit.

Due to the construction of the invention, even when trains of different types stop at the platform and the positions and widths of the entrances are not fixed, the sliding doors or the folding doors disposed continuously along the platform edge which correspond to the entrances are correctly selected. The thus selected sliding doors or folding doors can be opened in conformity with the entrances by the opening and closing driving apparatus and by setting a suitable opening direction and stroke amount. The invention also makes the boarding and exit of passengers smooth and safe.

What is claimed is:

1. A sliding door apparatus for a railway platform, comprising:

a plurality of sliding doors provided along an edge of a railway platform, the plurality of sliding doors being, in a closed position, arranged continuously aligned with the edge of the railway platform;

a sliding door shifting apparatus for selectively shifting selected sliding doors to be opened and closed into shifted positions parallel to the closed position of the plurality of sliding doors;

opening/closing apparatus for opening and closing the sliding doors disposed at the shifted positions, the opening/closing apparatus being capable of opening and closing the sliding doors by moving the doors in varying directions and amounts; and a logic apparatus for analyzing information regarding the positions and widths of entrances of a railway vehicle stopped at the platform, selecting the selected sliding doors to be shifted, and controlling the shifting and opening/closing of the sliding doors such that the sliding doors are opened and closed in conformity with the entrances of the railway vehicle.

* * * * *